US006966611B1

(12) United States Patent
Sollami

(10) Patent No.: US 6,966,611 B1
(45) Date of Patent: Nov. 22, 2005

(54) ROTATABLE TOOL ASSEMBLY

(75) Inventor: Phillip A. Sollami, Herrin, IL (US)

(73) Assignee: The Sollami Company

( * ) Notice: Subject to any disclaimer, the term of this patent is extended or adjusted under 35 U.S.C. 154(b) by 0 days.

(21) Appl. No.: 10/828,822

(22) Filed: Apr. 21, 2004

Related U.S. Application Data

(63) Continuation-in-part of application No. 10/345,562, filed on Jan. 16, 2003, now Pat. No. 6,863,352.

(60) Provisional application No. 60/352,112, filed on Jan. 24, 2002.

(51) Int. Cl.[7] ..... E21C 35/19
(52) U.S. Cl. ..... 299/104; 299/107
(58) Field of Search ..... 299/104, 107, 299/105; 411/531, 533

(56) References Cited

U.S. PATENT DOCUMENTS

| | | | | |
|---|---|---|---|---|
| 3,259,404 | A * | 7/1966 | Papenguth | 411/531 |
| 3,726,178 | A * | 4/1973 | Dimitry | 411/371.1 |
| 4,702,657 | A * | 10/1987 | Jelinek | 411/533 |
| 5,931,542 | A * | 8/1999 | Britzke et al. | 299/104 |

* cited by examiner

*Primary Examiner*—John Kreck
(74) *Attorney, Agent, or Firm*—Robert L. Marsh

(57) ABSTRACT

A tool assembly includes an axially symmetric tool having a tapered forward end, a radial flange, and a cylindrical shank. A retainer is fitted around the cylindrical shank, a washer is fitted around the retainer, and an annular elastomeric member is bonded to the inner surface of the washer. When the rotatable shank is fitted into a cylindrical mounting bore of a tool holder, the annular elastomeric member prevents the washer from rotating with the tool.

15 Claims, 3 Drawing Sheets

ROTATABLE TOOL ASSEMBLY

This is a continuation in part of my previously filed application Ser. No. 10/345,562 filed Jan. 16, 2003 now U.S. Pat. No. 6,863,352, which in turn claimed priority from my previously filed provisional application filed Jan. 24, 2002 and assigned Ser. No. 60/352,112. The present invention relates to a mounting for rotatable tools used to cut hard surfaces and, in particular, to an improved mounting having a washer to protect portions of the mounting block that retains the tool and having an annular elastomeric member for centering the washer.

BACKGROUND OF THE INVENTION

A machine for cutting hard surfaces has a rotatable member such as a wheel or a drum which turns about an axis and has a plurality of cutting tools mounted on the rotatable member. To advance the cut, the rotating member is applied against the hard surface such that each tool removes a small portion of hardened material.

To maximize their useful life, the cutting tools are rotatably mounted about a longitudinal axis and have a cylindrically mounted portion rotatably fitted in a cylindrical aperture on a mounting block on the rotating member. To transfer force from the mounting block to the tool, the tool is provided with an annular flange having a planar rear surface which rests upon the planar forward surface of the mounting block surrounding the aperture such that the forward surface of the mounting block applies force to the rear surface of the flange.

Each of the tools also has a tapered forward cutting end with a tungsten carbide insert at the forward end thereof for cutting into the hard surfaces. As the machine cuts hard material, such as concrete or asphalt, fragments of the broken material are forced across the tapered forward end of the tool and around the sides of the mounting block causing wear, or wash away, of the material which make up both the tool body and the mounting block. After a substantial portion of the forward end of the tool has been worn away, the tool must be replaced. Similarly, after a substantial portion of the mounting block has been washed away, the mounting block must also be replaced.

A recent improvement in such machines is a quick-change assembly wherein the cylindrical shank of the tool is received in a tubular retainer. The tubular retainer is then fitted into a mounting block on the machine. In this configuration, it is the tubular retainer and not the mounting block which suffers wash away when the machine is in use. The tubular retainer can be more easily replaced than the block into which it is mounted, thereby simplifying the repair of the machine.

Other improvements have also enhanced the life of the mounting block. For example, the radial flanges of the tools have been enlarged to protect the block from damage caused by wash away. In my co-pending application Ser. No. 09/505,088, 1 also disclosed a tungsten carbide insert provided at the forward end of the mounting block to reduce the damage to the block caused by the rotation of the tool within the cylindrical bore. As a result of such improvements, as many as one hundred tools may be worn out before a mounting block suffers such wear that it, too, must be replaced.

The tools used in such machines are symmetric about their longitudinal axis and the rotation of the tool within the cylindrical mounting causes the tool body to wear evenly around its circumference. Even so, such tools become worn very rapidly and it is common to replace all of the tools on a machine after a single day of usage. A tool which does not rotate properly, however, will fail prematurely and the failure of several tools on a machine can cause the machine to be taken out of service before completion of a day's work. Proper rotation of the tools is, therefore, essential for operating the machine efficiently.

It has become common to provide a washer around the circumference of the tool shank such that the washer is positioned between the forward surface of the tool body and the flange of the tool. The washer is made of a hardened steel and has a polished surface which acts as a bearing on which the rear surface of the flange is rotatable thereby enhancing tool rotation. When a tool becomes worn, both the tool and the washer are removed from the mounting block for the tool retainer and replaced with a new tool and a new washer.

Certain new problems are created, however, by the provision of a washer. For example, the tools have a frustoconical portion between the shank and the rearward surface of the flange and, therefor, the washer must have an inner diameter equal to the largest diameter of the frustoconical portion. If the washer is not properly centered on the tool while it is being inserted into the retainer or tool block, the washer will prevent the tool from being properly seated in its holder. An improperly seated tool will not rotate properly, and will contribute to the premature failure of the tool holder.

To operate properly, the washers in such assemblies are to remain stationary with respect to the tool holder and not rotate with the tool. Where the tool holder is provided with a polished forward surface, the washer may tend to rotate with the tool and thereby defeat its purpose. Where the tool holder is fitted with a tungsten carbide ring at the forward end therefore, such as disclosed in my co-pending application Ser. No. 09/505,088, there is a high likelihood that the washer will rotate with the tool because the tungsten carbide of the ring has a lower coefficient of friction than does the steel of the washer. It is desirable, therefore, to provide a method for facilitating the centering of the washer with respect to the tool and for retaining the washer stationary with respect to the tool holder and against rotation with the tool.

SUMMARY OF THE INVENTION

Briefly, the present invention is embodied in an assembly for retaining a rotatable tool within a tool holder where the tool holder has a planar forward mounting surface and a cylindrical hole with a frustoconical counter sink, the axis of which is perpendicular to the mounting surface into which a cylindrical shank on the tool is received.

The assembly includes a tool having a tapered forward cutting end, a radial flange aligned axially behind the forward cutting end, and a cylindrical shank axially aligned behind the radial flange. Between the shank and the radial flange is a frustoconical portion to facilitate the alignment of the tool within the tool holder. An expandable retainer sleeve is fitting around the circumference of the shank to retain the shank of the tool in the cylindrical hole of the tool holder.

In accordance with the invention, a washer having an inner annular surface having a diameter which is greater than the diameter of the transverse hole into which the shank and retainer sleeve are inserted is fitted around the shank of the tool and the retainer sleeve thereon. Bonded to the inner annular surface of the washer is a rubberized annular elastomeric member, the outer circumference of the annular elastomeric member being bonded to the inner surface of the washer such that the washer and an annular elastomeric member form a single part. The annular elastomeric member has an inner diameter that is less than that of the inner diameter of the cylindrical hole in the tool holder. Accordingly, when the washer with the annular elastomeric member bonded thereto is fitted over the shank of the tool and the retaining sleeve, the compressible qualities of the annular elastomeric member will retain the part (washer and annular elastomeric member) from falling off the end of the shank, thereby retaining the parts in their desired relationship until the tool is placed in use.

To replace a tool assembly in accordance with the present invention, the worn tool is removed from the tool holder along with its associated retainer sleeve, washer and an annular elastomeric member and all these parts are discarded. Thereafter, the shank of the replacement tool is inserted into the bore of the tool holder. As the shank and retainer sleeve are pressed into the bore of the tool holder, the annular elastomeric member will become seated in the frustoconical countersink at the forward end of the tool holder. As the shank and sleeve become fully inserted into the mounting hole, the washer bonded to the annular elastomeric member will become centered between the forward surface of the tool holder and the rear surface of the flange of the tool.

After the tool is assembled into the tool holder, the inner circumference of the annular elastomeric member will abut against the forward end of the sleeve and thereby retain the washer against rotation with the tool. When the tool rotates within the tool holder, the rearward surface of the flange of the tool will rotate on the forward surface of the washer such that the washer becomes worn rather than the forward end of the tool holder.

BRIEF DESCRIPTION OF THE DRAWINGS

A better and more complete understanding of the present invention will be had after a reading of the following detailed description taken in conjunction with the following drawings where.

DETAILED DESCRIPTION OF THE PREFERRED EMBODIMENT

Figure 1:
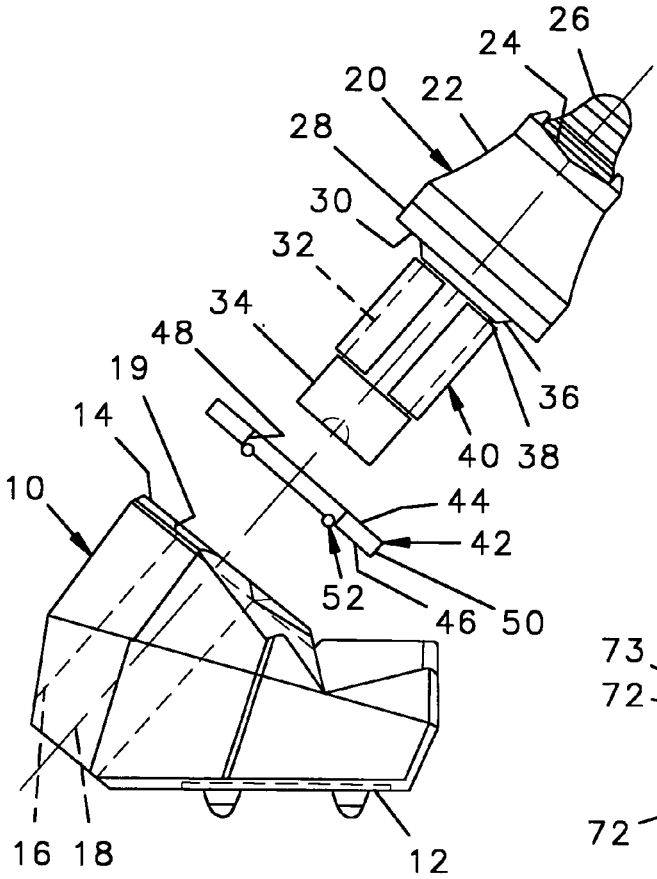
FIG. 1 is an exploded view of a tool mounting block and tool assembly in accordance with the present invention with portions of the interior of the block shown in broken lines.

Referring to FIG. 1, a tool holder or mounting block 10 is made of alloy steel and has an alignment portion 12 to align the block 10 as it is welded to the rotating member (not shown) of a machine. The block 10 further has a planar forward surface 14 and extending through the body of the block is a transverse hole 16 having a longitudinal axis 18 perpendicular to the forward surface 14. Near the forward surface 14 and surrounding the end of the hole 16 is a frustoconical counter sink 19 to facilitate the alignment of a tool as it is inserted into the block 10.

Referring to FIGS. 1, 3, 4 and 5, received within the transverse hole 16 is a tool 20 having a tapered forward end 22, at the most forward end of which is seat 24 into which is fitted a tungsten carbide insert 26. Rearward of the tapered forward end 22 is a radial flange 28, having a planar rear surface 30. Positioned axially behind the planar rear surface 30 is cylindrical shank 32 having an enlarged hub 34 at the distal end thereof. Between the cylindrical shank 32 and the planar rear surface 30 of the flange is a frustoconical portion 36, and between the frustoconical portion 36 and the shank 32 is a radial shoulder 38.

Fitted around the circumference of the cylindrical shank 32 is a retainer sleeve 40 having a "C" shaped cross section which is biased to expand to an outer diameter which is larger than the inner diameter of the transverse hole 16. The retainer sleeve 40 has an axial length which is a little less than the length of the shank 32 from the forward end of the hub 34 to the shoulder 38 such that the retainer 40 can be compressed around the shank 32 and the shank, with the retainer sleeve 40 thereon, inserted into the hole 16 of the mounting block 10. When the shank 32 is fully inserted into the hole 16, the radial pressure of the sleeve 40 will retain the tool therein and the cylindrical shank 32 will be rotatable within the retainer sleeve 40.

Fitted around the circumference of the shank 32 is a washer 42 having a planar forward and rearward surfaces 44, 46 respectively, an inner annular surface 48 and an outer surface 50. In the preferred embodiment, the diameter of the inner annular surface 48 is at least equal to the largest diameter of the frustoconical portion 36 of the tool 20 and the outer surface 50 has a diameter that is about twenty percent little larger than the largest outer diameter of the radial flange 28. The washer 42 is preferably made of hardened steel or stainless steel and the forward surface 44 thereof is a smooth bearing on which the rear surface 30 of the flange rotates.

Bonded to the inner annular surface 48 of the washer 42 is an annular elastomeric member 52 having an inner surface 54 the diameter of which is a little smaller than that of the inner diameter of the transverse hole 16, and has an outer diameter that is greater than the diameter of the transverse hole 16. Preferably, the annular elastomeric member 52 is formed in a mold that also retains the washer 42 such that the annular elastomeric member 52 is molded to the inner annular surface 48 of the washer 42.

Figure 3:
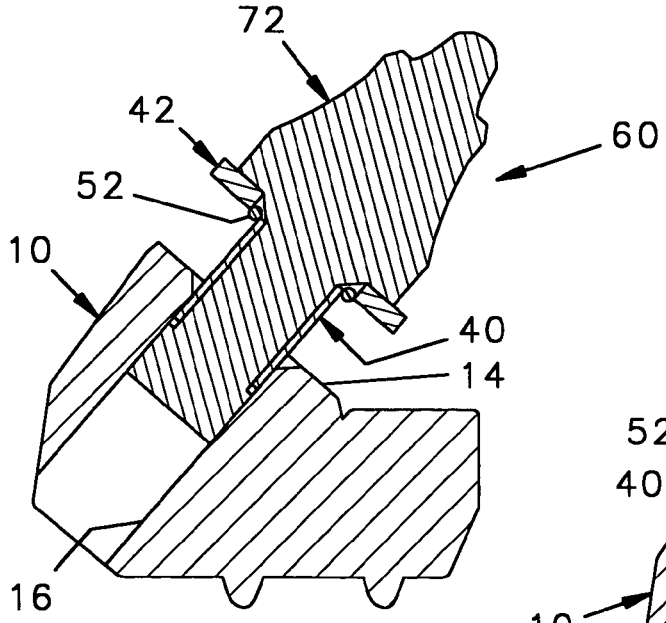
FIG. 3 is a cross sectional view of the assembly as shown in FIG. 1 partially inserted into the mounting block.
Figure 4:
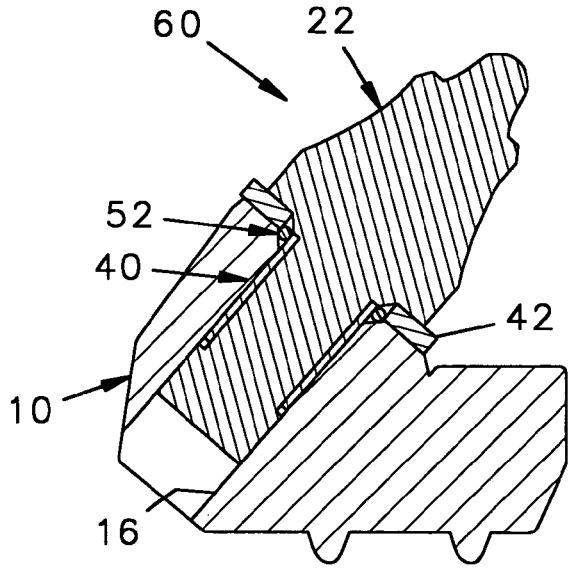
FIG. 4 is another cross sectional view of the block and assembly shown in FIG. 1 with the tool fully inserted into the block.
Figure 5:
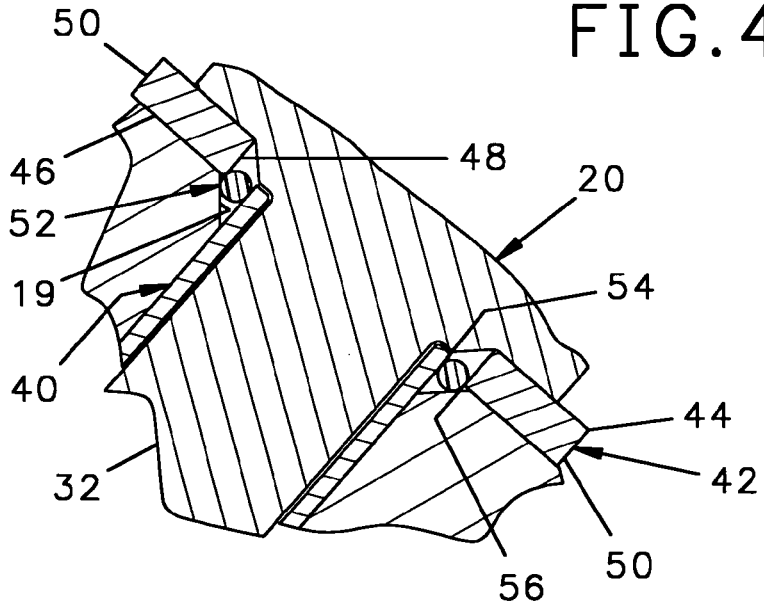
FIG. 5 is a fragmentary enlarged cross sectional view of the annular elastomeric member, washer, and portions of the tool and tool holder as shown in FIG. 4.

As best shown in FIG. 3, the parts form a replacement tool assembly 60 that includes a tool 20, a retainer sleeve 40, and a washer 42 with the annular elastomeric member 52 attached thereto. The replacement parts are retained in assembled relationship with the retainer sleeve 40 fitted around the circumference of the shank 32, and the washer 42 and an annular elastomeric member 52 fitted over the shank 32 and the retainer sleeve 40. The annular elastomeric member 52 thereby retains the washer from falling off the end of the shank 32.

Figure 2:
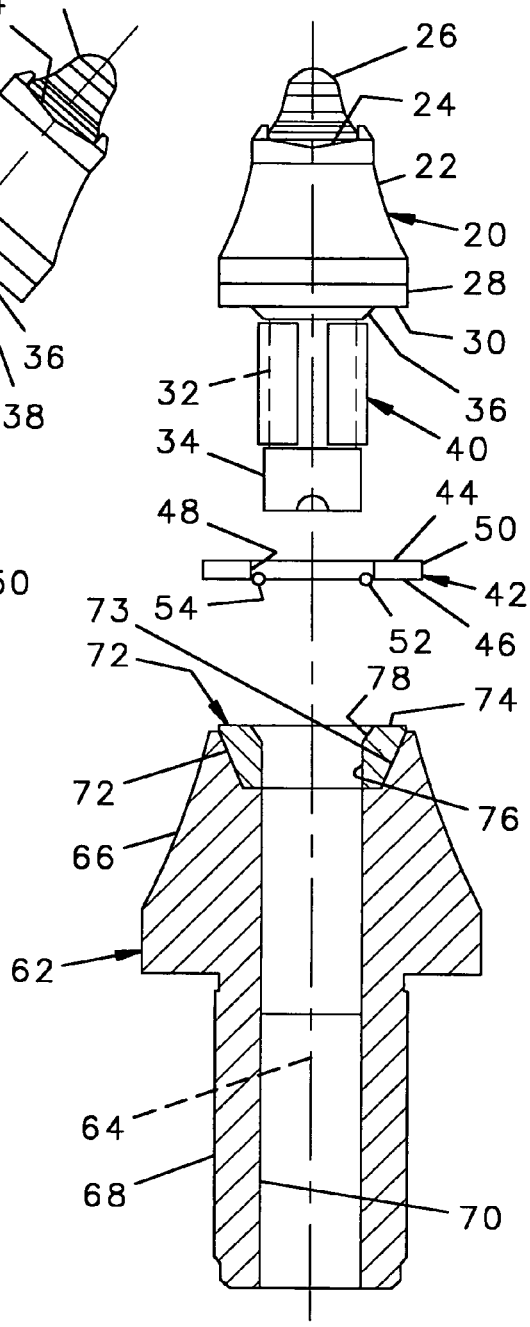
FIG. 2 is an exploded cross sectional view of a quick change holder having a tungsten carbide wear ring at the forward end thereof and a tool assembly in accordance with the invention fitted therein.
Figure 6:
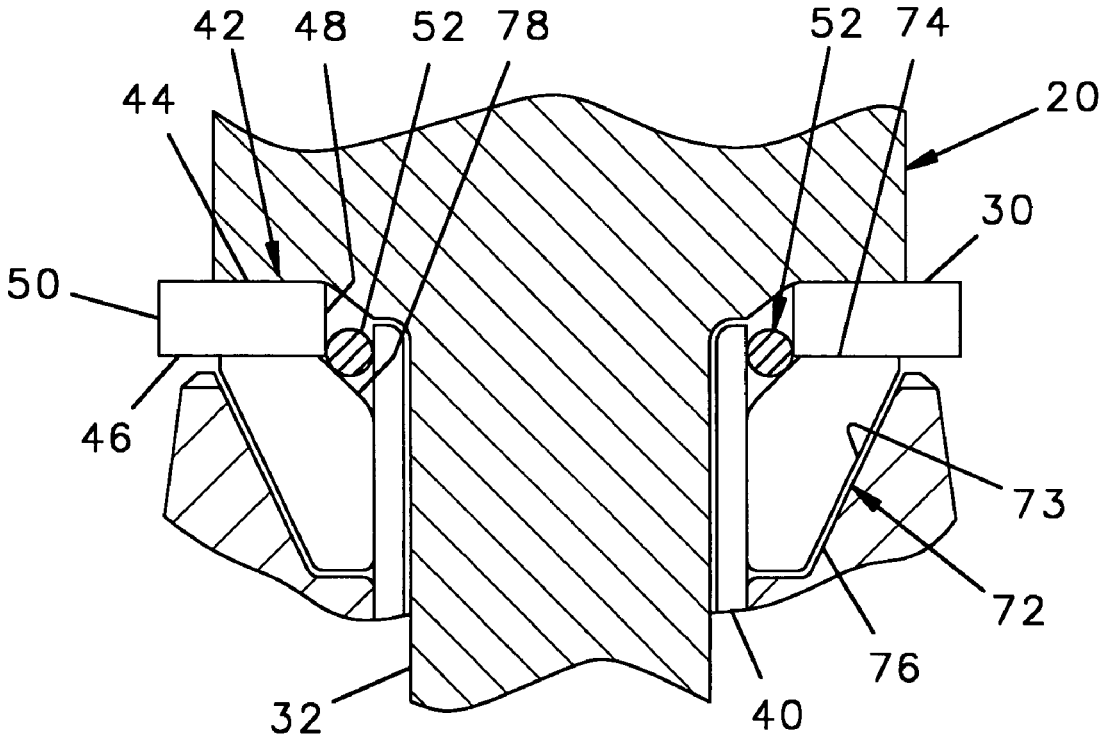
FIG. 6 is a fragmentary enlarged cross sectional view of the annular elastomeric member, washer, tool and tool holder shown in FIG. 2 with the tool completely assembled and showing in detail the wear ring, the washer and the annular elastomeric member.

Referring to FIGS. 2 and 6, the tool assembly 60 is also insertable in a quick change tool holder 62. The tool holder 62 is symmetric about a longitudinal axis 64 and has a tapered forward end 66, a cylindrical mounting portion 68 and an axial hole 70 having an inner diameter sized to retain the shank 32 of a tool 20 with the sleeve 40 thereon. A quick-change holder in accordance with my co-pending application Ser. No. 90/505,088 further has a tungsten carbide wear ring 72 fitted into a countersink 73 at the forward end of the tapered forward end 66. The ring 72 has a planar forward surface 74, an inner surface 76 with a diameter approximately equal to the inner diameter of the transverse hole 70, and a frustoconical countersink 78 to facilitate the alignment of the tool 20 as the shank 28 is inserted into the transverse hole 70.

Referring to FIGS. 2, 4, 5, and 6, when the tool assembly 60 is inserted into a mounting block 10 or a tool holder 62, the inner surface 54 of the annular elastomeric member 52 will fit around the upper end of the outside diameter of retainer sleeve 40 and the outer surface 56 thereof will abut against the inner surface 48 of the washer 42. Since the retainer sleeve 40 is biased to expand within the transverse hole 16, 70 of the block 10 or holder 62, the retainer sleeve 40 will not rotate with the tool 20. The annular elastomeric member 52, therefore, engages the stationary retainer sleeve 40 and the frustoconical countersink 78 thereby preventing the washer 42 from rotating with the tool 20. Also, since the annular elastomeric member fits within the inner diameter of the washer 42, the annular elastomeric member 52 facilitates the alignment of the washer 42 with respect to the transverse mounting holes 16, 70.

In accordance with another feature of the invention, the outer surface 50 of the washer 42 has a larger diameter than that of the radial flange 28 such that the outermost portions of the washer 42 provide additional protection for the forward surfaces of the mounting block 10 or tool holder 62. Also, the annular elastomeric member 52 serves as a seal against fine particles of hard material loosened by the cutting tool 10 from working along the forward or rearward surfaces 44, 46 of the washer 42 and into the transverse holes 16, 70 of the tool holder. The presence of fine particles between the shank 32 and the inner surface of the transverse holes 16, 70 and the frustoconical countersink 19, 78 will cause these parts to become worn prematurely.

While the present invention has been described with respect to two embodiments, it will be appreciated that many modifications and variations may be made without departing from the true spirit and scope of the invention. It is, therefore, the intent of the appendent claims to cover all such variations and modifications which fall within the true spirit and scope of the invention.

What is claimed:

1. A tool assembly for insertion into a tool holder having a planar forward surface and a transverse mounting hole having and an inner diameter, said tool assembly comprising in combination a tool having a tapered forward cutting end, a radial flange aligned axially behind said forward cutting end, a cylindrical shank aligned axially behind said radial flange, and said cylindrical shank having an outer diameter less than said inner diameter of said transverse hole, a retainer sleeve around said cylindrical shank for retaining said shank in said cylindrical hole, a washer having an inner annular surface, a forward surface and a rearward surface, said inner annular surface having a diameter greater than that of said shank, a layer of compressible material bonded to said inner annular surface, no portion of said compressible material extending forward of said forward surface of said washer, said retainer sleeve fitted around a circumference of said shank, and said washer fitted around said shank and said retainer sleeve, wherein said layer of compressible material will retain said washer on said shank.

2. The tool assembly of claim 1 wherein an inner surface of said compressible material has a diameter less than said inner diameter of said transverse mounting hole.

3. The tool assembly of claim 1 wherein said layer of compressible material is an annular elastomeric member bonded to said inner annular surface.

4. An assembly for retaining a tool in a tool holder comprising a tool holder having a transverse cylindrical hole with a longitudinal axis and an inner diameter, said holder having a planar forward surface perpendicular to said axis, means for retaining said tool holder to a machine, a tool having a tapered forward cutting end, a radial flange axially aligned behind said forward cutting end, a cylindrical shank axially aligned behind said radial flange, and said cylindrical shank having an outer diameter less than said inner diameter of said transverse hole, a retainer sleeve around said cylindrical shank for retaining said shank in said cylindrical hole, a washer having an inner diameter, a forward surface and a rearward surface, said retainer sleeve fitted around a portion of said shank, said washer fitted around said shank and around said retainer sleeve, said shank and said retainer sleeve fitted into said transverse hole, and an annular elastomeric member having an inner surface and an outer surface, said inner surface of said annular elastomeric member fitted around said retainer sleeve and said outer surface of said annular elastomeric member bonded to said inner surface of said washer wherein said washer is retained against rotation with said tool.

5. The tool assembly in accordance with claim 4 wherein said cylindrical hole has a frustoconical counter sink and said annular elastomeric member is seated in said frustoconical counter sink.

6. A tool assembly in accordance with claim 4 wherein said tool holder has a tungsten carbide wear ring.

7. The tool assembly of claim 4 wherein said inner surface of said annular elastomeric member has a diameter less than said inner diameter of said transverse mounting hole.

8. The tool assembly of claim 4 wherein said tool holder is made from alloy steel.

9. The tool assembly of claim 4 wherein said annular elastomeric member has an outer diameter greater than a diameter of said transverse cylindrical hole.

10. In an assembly for retaining a tool in a tool holder having a tool holder having a transverse cylindrical hole with a longitudinal axis and an inner diameter, said holder having a planar forward surface perpendicular to said axis, means for retaining said tool holder to a machine, a tool having a tapered forward cutting end, a radial flange axially aligned behind said forward cutting end, a cylindrical shank axially aligned behind said radial flange, and said cylindrical shank having an outer diameter less than said inner diameter of said transverse hole, a retainer sleeve around said cylindrical shank for retaining said shank in said cylindrical hole, a washer having an inner diameter, a forward surface and a rearward surface, said retainer sleeve fitted around a portion of said shank, said washer fitted around said shank and around said retainer sleeve, and said shank and said retainer sleeve fitted into said transverse hole, the improvement comprising an annular elastomeric member having an inner surface and an outer surface, said inner surface of said annular elastomeric member fitted around said retainer sleeve and said outer surface of said annular elastomeric member bonded to said inner surface of said washer wherein said washer is retained against rotation with said tool.

11. The improvement of claim 10 wherein said cylindrical hole has a frustoconical counter sink and said annular elastomeric member is seated in said frustoconical counter sink.

12. The improvement of claim 10 wherein said tool holder has a tungsten carbide wear ring.

13. The improvement of claim 10 wherein said inner surface of said annular elastomeric member has a diameter less than said inner diameter of said transverse mounting hole.

14. The tool assembly of claim 10 wherein said tool holder is made from alloy steel.

15. The tool assembly of claim 10 wherein said annular elastomeric member has an outer diameter greater than a diameter of said transverse cylindrical hole.

* * * * *